United States Patent [19]

Cherrington

[11] 4,078,617

[45] Mar. 14, 1978

[54] PORTABLE DRILL RIG FOR BORING UNDERGROUND INVERTED ARCUATE PATHS

[76] Inventor: Martin D. Cherrington, 1111 S. Post Oak Rd. No. 225, Houston, Tex. 77056

[21] Appl. No.: 779,459

[22] Filed: Mar. 21, 1977

[51] Int. Cl.[2] ..... E21C 11/02

[52] U.S. Cl. ..... 173/1; 52/116; 173/23; 173/28

[58] Field of Search ..... 52/116, 117; 173/1, 173/22, 23, 28, 44, 147, 151; 175/53, 61, 62, 122, 170; 254/139.1

[56] References Cited

U.S. PATENT DOCUMENTS

| | | | |
|---|---|---|---|
| 2,969,121 | 1/1961 | Wallace | 175/170 X |
| 3,638,375 | 2/1972 | Vasiliev et al. | 52/116 |
| 3,682,261 | 8/1972 | Bird | 175/122 |
| 3,922,825 | 12/1975 | Eddy et al. | 52/116 |

FOREIGN PATENT DOCUMENTS

| | | | |
|---|---|---|---|
| 68,221 | 10/1957 | France | 52/116 |
| 1,370,833 | 7/1964 | France | 254/139.1 |

*Primary Examiner*—Lawrence J. Staab

*Attorney, Agent, or Firm*—Townsend and Townsend

[57] ABSTRACT

A portable drill rig having an inclined ramp is transportable in discrete sections with each section of the inclined ramp forming a separate truckbed chassis. In erection the front portion of the ramp is swung upwardly with on-site lifting apparatus. Support legs are pendulously swung down and landed on portable landing pads to support the medial section of the front ramp in an angular inclined position. The rear ramp section is lifted at the medial rig section and its large supporting legs allowed to pendulously swing on the ground towards their eventual position. A pin registry is made between the two ramp sections so that the partially erected ramp appears not unlike an apex of a roof. The rear portion of the ramp is then erected to its full angularly inclined position and pinned. Provision is made to utilize a traveling car mounted for movement on the ramp sections for the erection of the ramp legs on both ramp sections.

13 Claims, 17 Drawing Figures

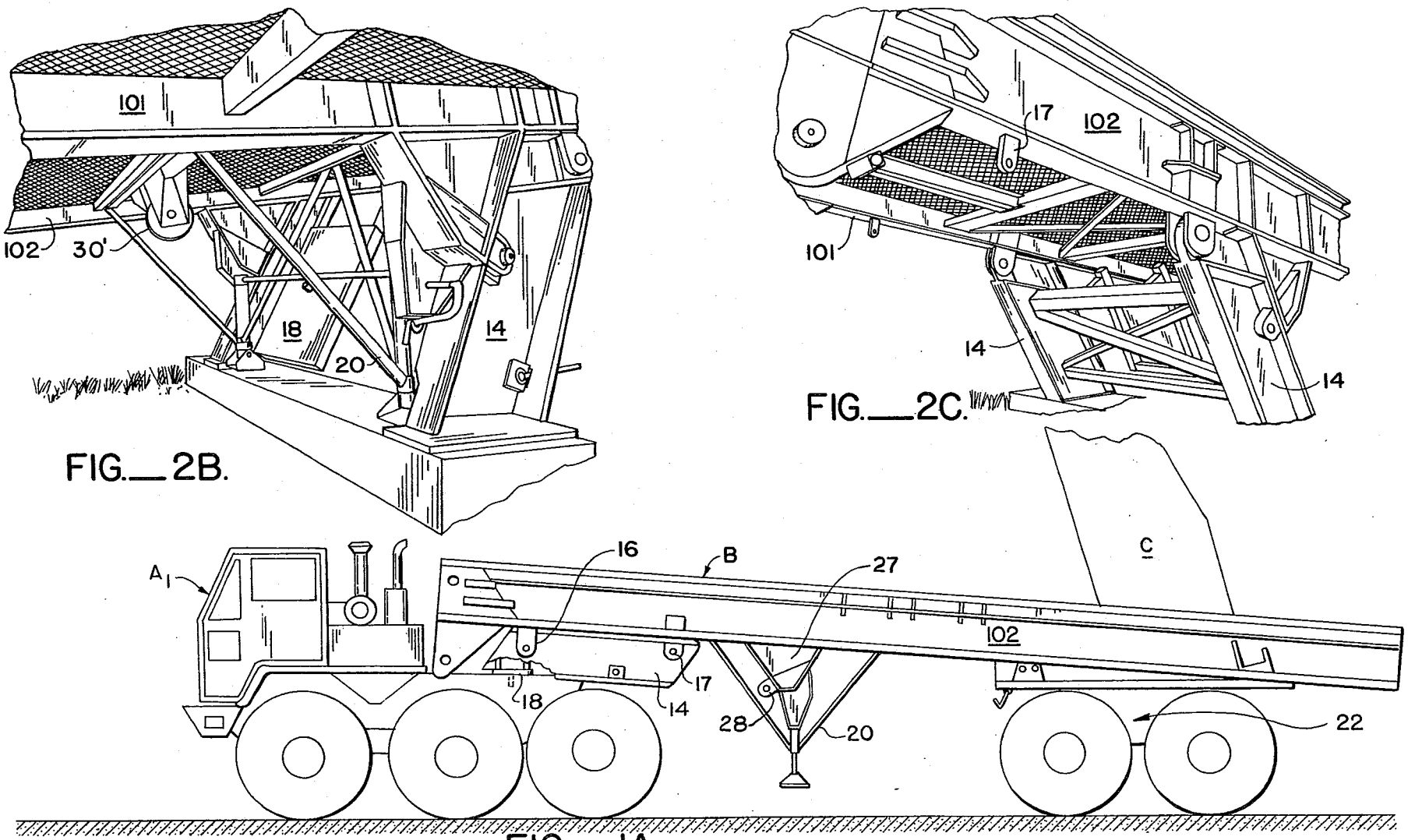
FIG.__2C.
FIG.__2B.
FIG.__1A.

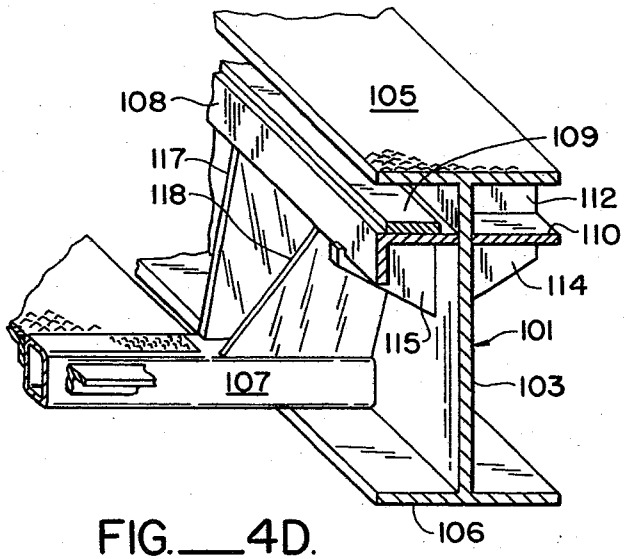
FIG.__4D.
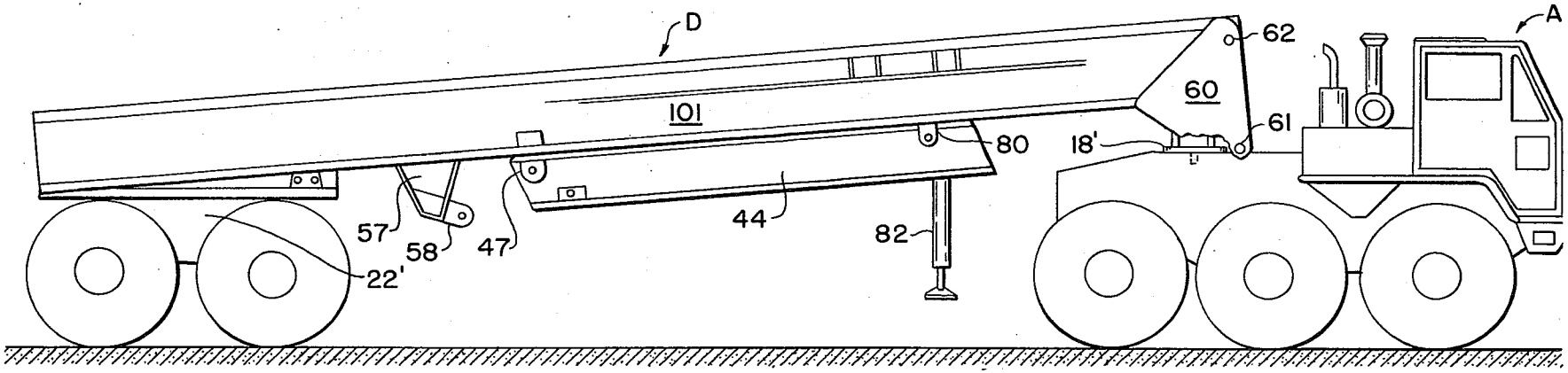
FIG.__1B.

PORTABLE DRILL RIG FOR BORING UNDERGROUND INVERTED ARCUATE PATHS

This invention relates to portable drilling rigs. More particularly, a portable drill rig for the inclined drilling of pipe into the ground is disclosed.

SUMMARY OF THE PRIOR ART

Inclined drill rigs are known. Heretofore a ramp has typically been hinged upon itself and transported as a single load. This has had several disadvantages. First, because of highway load limitations such ramps have been of light construction. Secondly, even when such rigs are built, their transport to limited access sites has been restricted. They are too heavy and too bulky to be transported down rural access roads to drilling sites. Finally, the demand for placement of large casings going longer distances has required rigs of high crowding power and high torque.

Typically, these inclined drill rigs are used for boring inverted arcuate paths of pipe underneath obstacles such as rivers. In a typical application, a pilot string is first installed along the precise course designed for an inverted arcuate path. See U.S. Pat. No. 3,878,903, entitled "Apparatus and Method for Drilling Underground Arcuate Paths." Simultaneously with the installation of the pilot string, a following liner (commonly of "washover shoe" type piping) is introduced behind the pilot string. This washover shoe conserves the path made by the pilot string as well as facilitating the withdrawal and reentry of the pilot string into the length of the hole. See U.S. patent application Ser. No. 506,920, filed Sept. 17, 1974, entitled "Apparatus and Process for Drilling Underground Arcuate Paths Utilizing Directional Drill and Following Liner," now U.S. Pat. No. 4,003,440.

When the pilot string and washover shoe have fully penetrated from one side of an obstacle to the other side of an obstacle, the washover shoe is in turn concentrically theaded with a larger pipe. This larger pipe can be a production casing or can be one of a series of increasingly larger pipes. For example, see my copending U.S. patent application Ser. No. 595,829, filed July 14, 1975, entitled "Method for Placement of Production Casing Under Obstacle, " now U.S. Pat. No. 3,996,758.

The drill rig of this invention is included for use with these techniques.

SUMMARY OF THE INVENTION

A portable drill rig having an inclined ramp is transportable in discrete sections with each section of the inclined ramp forming a separate truckbed chassis. The inclined ramp is transported by a fifth wheel mounted to a conventional trucking tractor at one end and detachably mounted wheels. In erection the front portion of the ramp has its wheels removed on site and the rear section of the ramp is swung upwardly with on-site lifting apparatus. Legs having the fifth wheel and landing gear thereon are pendulously swung down and landed on portable landing pads to support the medial section of the front ramp in an angular inclined position. A traveling car can then be mounted to the forward ramp section by entrance to open opposed U-shaped rails on opposite sides of the I-beams forming the ramp. This car is typically tied off at the top of the ramp section and at the bottom of the ramp section to a climbing cable. The rear ramp section is lifted at the medial rig section and its large supporting legs allowed to pendulously swing on the ground towards their eventual position. A pin registry is made between the two ramp sections so that the partially erected ramp appears not unlike an apex of a roof. The rear portion of the ramp is then erected to its full angularly inclined position and pinned. Provision is made to utilize the traveling car for the erection of the ramp legs on both ramp sections. The rig is made fully operational by slip-on catwalks and pipe racks on opposite sides of the rig. Convenient breakdown and off-site transport of the rig is accomplished by reversing the assembly procedure.

OTHER OBJECTS AND ADVANTAGES OF THE INVENTION

An object of this invention is to set forth an inclined ramp drill rig with a portable configuration applicable for rig transport down substandard rural access roads. According to this aspect of the invention an inclined ramp with folding legs is utitized. The inclined ramp is broken down into at least two chassis sections. Supporting legs for each chassis section are pivoted from under the respective drill rig to an erected, typically over-center position.

An advantage of this drill rig is that it is conveniently hauled to a remote drilling site. Transport of the rig virtually anywhere a tractor and trailer can travel is enabled.

A further advantage of the sectionalizing of the drill rig is that the assembled rig is large enough to handle long casings of large diameter.

A further object of this invention is to disclose a drill rig of great strength which is easily assembled by lifting apparatus portable into the field. Accordingly, the angularly inclined front drill rig section is directed and put into place. A traveling car is mounted on the front section of the rig. The rear section of the rig is first pinned and then hingedly swung into place with the assistance of the traveling car. The large supporting legs for the rear section of the rig are pivoted overcenter and swung into supporting position.

An advantage of the erection sequence of this invention is that the front erected ramp section forms a pivot point for erecting the rear ramp section.

Yet another advantage of the erection sequence is that the car containing the drill head and crowding apparatus can assist in the assembly of its own drill rig ramp to swing the rear, heavy legs over center and into a braced position.

Yet another advantage of this assembly sequence is that a large inclined ramp can be completely assembled with a relatively light type handling crane with a minimum of special rigging and the like.

A further advantage of this invention is that when a ramp is assembled from discrete segments to a longer length, piping of that longer length can be installed in the ground. Joints in the pipe placed by welding or threaded connection can be minimized. Time of piping installation is reduced.

Other objects, features and advantages of this invention will become more apparent after referring to the following specification and attached drawings in which:

FIG. 1*a* is a side elevation of a tractor pulling the lower ramp section and loaded traveling car of the drill rig as an attached trailer;

FIG. 1*b* is a side elevation of a tractor pulling the upper ramp section of the drill rig as an attached trailer;

FIG. 2*a* is a side elevation of the lower portion of the drill rig as erected illustrating in schematic the lifting of the drill rig by an on-site piece of lifting equipment at one end with the use of the traveling car to erect the large supporting legs of the ramp;

FIGS. 2*b* and 2*c* are perspective details of the lower ramp section and supporting legs;

FIG. 3 is a side elevation in a reduced scale from that of FIG. 2*a* illustrating the pinning of the forward ramp section and after ramp section with the after ramp section still partially supported by its trailer transporting wheels;

FIGS. 4*a*–4*c* are side elevation sections illustrating the construction of the drill rig and catwalk;

FIG. 4*d* is an elevational perspective of the ramp sides of this invention illustrating the rail structure on which the traveling car of this invention rides;

FIG. 4*e* is a detail showing the suspension of catwalks from the main drilling rig;

FIG. 5*a* is a perspective view from above the traveling car of this invention shown separate and apart from the inclined ramp, the illustration here showing in broken lines the position of the cab;

FIG. 5*b* is a perspective view from below the traveling car shown separate and apart from the inclined ramp with the car shown only in the vicinity of the winch for powering forward and backward movement on the ramp;

FIG. 7 is a perspective view of the completely assembled inclined drill rig with pipe rack and catwalk all in place, the drill rig here being shown installing a pipe;

Figure 2A:
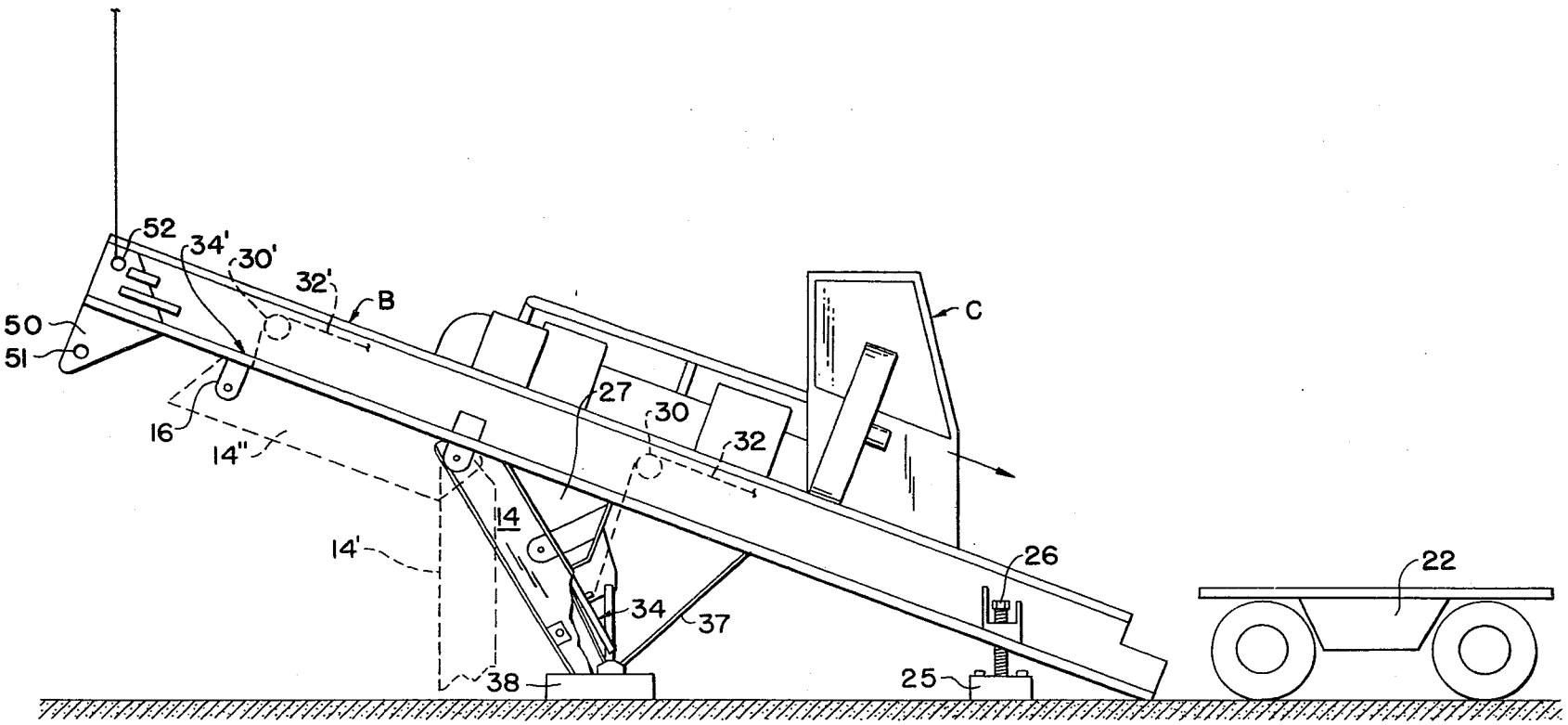

Referring to FIG. 1*a*, a six-wheel tractor $A^1$ is illustrated pulling lower ramp section B with attached traveling car C. Ramp section B includes supporting legs 14 pivoted about a pin 17 into folded juxtaposition with the lower portion of ramp B. Legs 14 are pinned at ears 16 so that the legs are rigidly juxtaposed to the bottom of the ramp B.

Legs 14 have fastened to the bottom portion thereof a fifth wheel 18. Wheel 18 and its associated pin are towed by the tractor and are on the bottom side of legs 14. (See detail of FIG. 2*b*.) Legs 14 comprise paired I-beams conventionally cross-braced.

As is apparent, ramp B is provided with conventional trailer landing gear 20. The landing gear 20 enables the tractor $A^1$ to deposit the ramp B in its substantial transporting disposition either in a job site or conventional equipment yard.

Ramp transporting wheels 22 are a standard item of manufacture. Typically they are braked by conventional air brake systems strung in hose conduit from the tractor. This hose conduit is not shown.

Referring to FIG. 2*a*, erection of the lower ramp section can be understood. Typically, wheels 22 are uncoupled from the after end of the tractor at standard wheel mounts. Thereafter, the front of the rig is landed by conventional lifting apparatus on a preplaced pad 25 and leveled as by screw jacks 26.

Thereafter, the rear section of the ramp is elevated by job site lifting apparatus such as a cherry picker crane (not shown). Upon elevation of the rear section, legs 14 are allowed to pendulously pivot against the ground until they depend to a substantially vertical position. (See broken lines at 14'.)

It will be made more apparent hereafter that car C is capable of independent self-powered movement on the ramp sections. This independent self-powered movement will be discussed later. However, at this juncture it is important to note that the independent self-powered movement of cab C is important in the erection of legs 14.

Specifically, when legs 14 are detached from ear 16 and allowed to pendulously move to the position shown at 14', the movement of these large, heavy legs to an over-center position is required. In this over-center position, the legs rest against an angularly inclined leg brace 27 where the legs are pinned into a ramp supporting position at ears 28. In order to accomplish this moving of the heavy legs, the movement of car C is utilized.

Specifically, a sheave 30 is mounted centrally of the ramp. This sheave 30 has a cable 32 wound about the sheave. Cable 32 is attached to car C at one end, and attached to the legs 14 at the other end (see arrow 34). Once the cable is attached, car C moves forwardly. In such forward movement, cable 32 is gathered towards the lower end of the ramp. Cable 32 serves to pull the legs to their over-center position against the brace 27 where pinning to the ears 28 may occur.

It will be appreciated that the same movement of car C can be utilized to fold the heavy supporting legs 14 into juxtaposition with the bottom of the forward ramp section B. Specifically, car C can travel the same cable 32' attached to the car at one end medially around sheave 30', and to the legs at the opposite end, such as the position indicated at 34'. In position 34', when car C moves forward it will gather cable 32' to the car. This will cause the legs to move from their pendulously vertical position 14' to the confronted position to the car 14'' in FIG. 2*a*. Thus it can be seen that the movement of the drilling rig of this invention has the serendipitous use of assisting the manipulation of the large supporting legs during assembly and disassembly of the lower ramp section B of this invention.

When leg 14 is in place, it is typically pinned at ear 28. It is further braced by a tie rod 37 and lands on a previously placed landing pad 38. With the car in the forward position, the lower end of the ramp is in effect self-supporting.

Referring to FIG. 1*b*, a six-wheel tractor $A^2$ is illustrated pulling the after section of the ramp D. Ramp D includes large supporting legs 44 connected to the lower upper end of the ramp at a hinge 47. A leg brace 57 with ear 58 is illustrated and used to lock the large supporting legs 44 into place on a job site.

Returning to the detail of FIGS. 1*a* and 2*a*, it will be seen that there is a connector assembly 50 at the tractor end of the ramp B. Connector assembly 50 includes a hinge pin aperture 51 and a locking pin aperture 52 which are utilized in connecting the paired ramp sections together.

Likewise and with reference to FIG. 1*b*, it can be seen that there is a connector section 60 at the tractor end of the upper ramp section D. Connector 60 includes a hinge pin aperture 61 and a locking pin aperture 62. Underneath these hinge pins and locking pins is the fifth wheel 18'. As in the case of the lower ramp section, the upper ramp section includes a pair of air braked transporting wheels 22' which are of the same standard manufacture.

Figure 3:
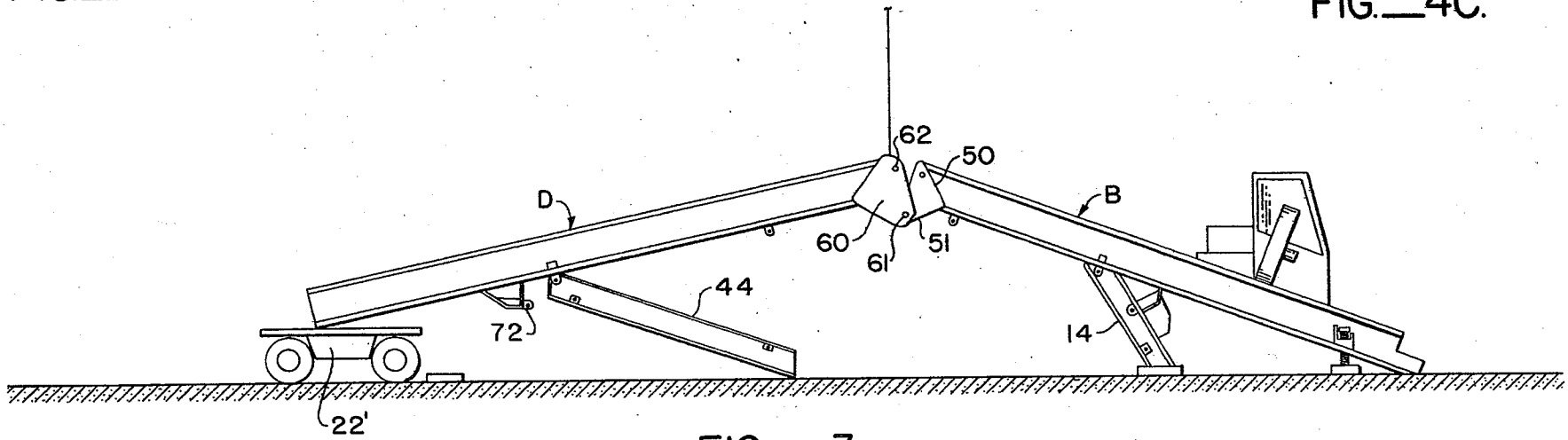

Referring to FIG. 3, the assembly of the upper ramp section to the lower ramp section can be easily understood. Specifically, upper ramp section D is elevated by lifting apparatus (not shown) connected to connector apparatus 60 at the vicinity of locking pins 62. Leaving the transporting wheels 22' in the unbraked disposition and partially attached to the upper end of ramp section D, the lifting apparatus is used to manipulate connector 60 of ramp D into juxtaposition with connector 50 of ramp section B. When juxtaposition occurs, a hinge pin is placed between apertures 51, 61 of the respective connector assemblies 50, 60. When the pin is in place, the two sections of the frame are in registry and the ramp is ready for assembly to the fully upright position.

Figure 6:
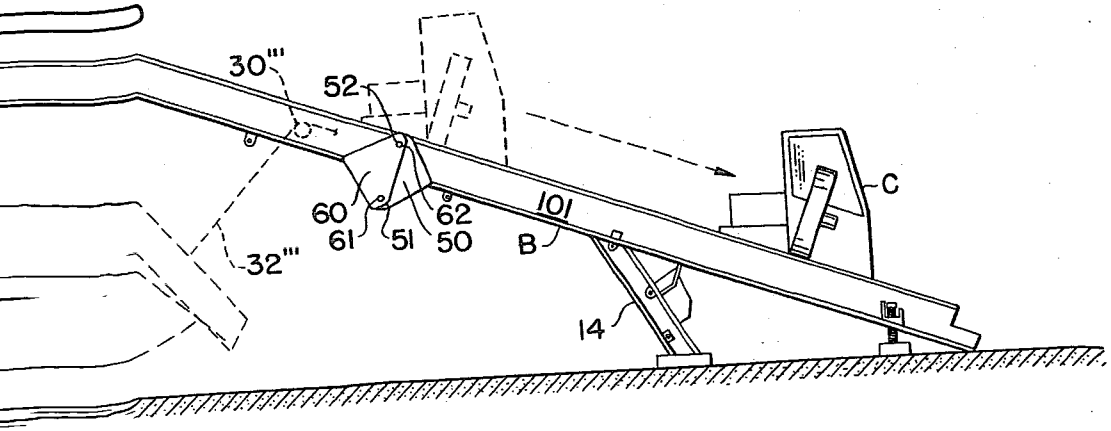
FIG. 6 is a side elevation generally on the scale of FIG. 3 illustrating the final assembly process of the drill rig and illustrating the traveling car and its use in erecting the large supporting legs of the drill rig.
Figure 4E:
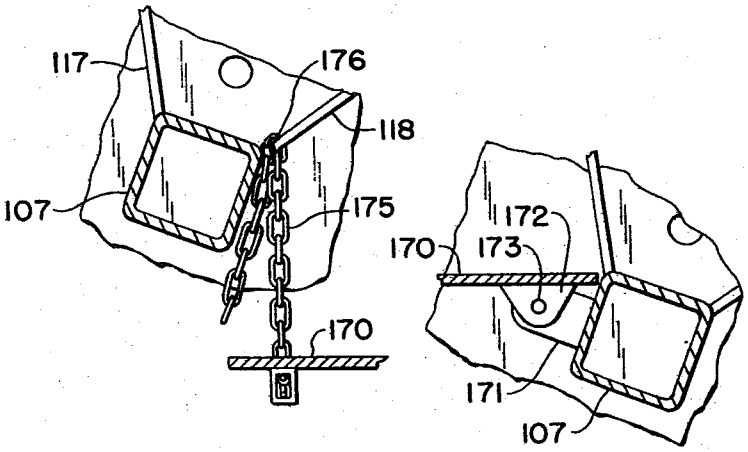
Figure 6:
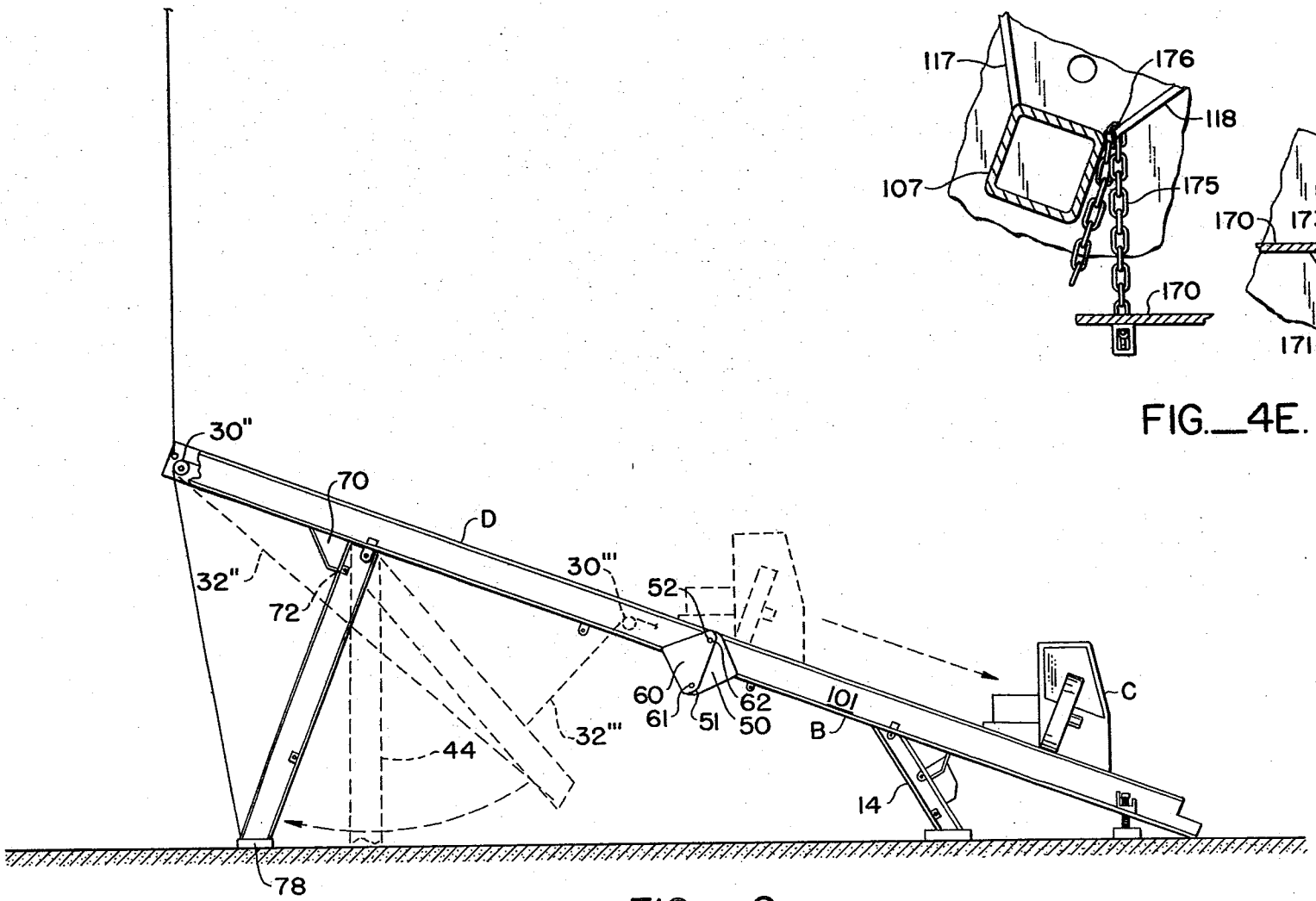

Referring to FIG. 6, the final assembly step of the large supporting legs of the ramp is illustrated. The lifting apparatus moves to the remote end of the ramp. At this point, it pivots ramp D upwardly into an erected position relative to ramp B. At this point, the connectors 50, 60 are pinned not only at their respective hinge pins 51, 61, but at their respective connector pins 52, 62. When this occurs, the entire length of the drill rig of this invention comprises a rigid, solid and unitary ramp.

The function of the coupling members 50, 60 is thus seen to include three functions. First, they permit a joinder of the two ramp sections to each other. Second, members 50, 60 permit the ramp sections to pivot about the formed connection to an erected disposition. Finally, the connectors permit the ramp sections to be locked together. Thus any connector which can accomplish these functions will serve the purpose of this portion of the invention.

During the erection of the after ramp section, the large supporting legs 44 will pendulously depend down into contact with the ground. Complete erection requires that these legs be lifted over-center during the erection procedure and locked. Such over-center movement and locking occurs against an over-center leg brace 70 at a pin extending through ear 72.

This over-center movement of the large legs 44 is accomplished by the same means as the erection of the legs 14 on ramp section B were made. Typically, the lifting apparatus lifts the entire connected ramps B, D upwardly a small distance into the air. At the same time, a sheave 30'' has a cable 32'' wound about it. One end of the cable 32'' goes to the lower end of legs 44. The opposite end of the cable attaches to the traveling car C.

Car C is activated to move in an angularly inclined path downwardly on the ramp. With this movement, cable 32'' is gathered to the car. When it is gathered to the car, movement of the large supporting legs to their over-center and final erected disposition occurs. The legs brace at brace 70. At the same time, they are pinned at ear 72. As in the case of the previously erected lower ramp section, the legs are made to land on a previously placed footing 78.

Disassembly of the legs and their juxtaposition to the underside of the ramp section D occurs by reversal of the process. Specifically, a sheave 30''' is placed medially of the ramp. This sheave 30''' has a cable 32''' passed to the legs. By forward movement of the car C, cable 32''' is gathered to the car. In such gathering of the car, large rear supporting legs 44 are moved into a position of juxtaposition with the underside of the lower ramp section. In such a position of juxtaposition, these legs can be captured at ears 80 and pinned in place. (See FIG. 1*b*.) As in the case of the lower ramp section, the upper ramp section is provided with a typical set of landing gears 82.

It will be appreciated that the sheaves illustrated herein may be generically described as "running rigging." Moreover, the cables described could be generically described as "flexible tension" apparatus. Equivalent devices such as chains and sprockets, ropes and pulleys, link mechanisms and the like can be used.

It should be understood that the traveling car C of this invention can either be transported with the forward ramp section or can be transported independently. In the event that the car C is to be independently transported, it is removed from the forward ramp section B before the after ramp section D is joined. Such removal occurs at and into the rail assembly which will hereinafter be explained with reference to the detail of FIG. 4*d*.

In actual practice the paired ramp sections each weigh approximately 16 tons. The traveling car weighs approximately 16 tons. Therefore, it can be seen that the drill rig of this invention can divide itself into three portable sections, all of approximately the same weight. These portable sections are of a weight and dimension whereby their transport to remote drilling sites, such as narrow country roads penetrating down to the banks of rivers. Thus the drill rig of this invention is ideally suited for transport to remote drilling sites.

Having set forth the overall operation of the discrete drill rig sections, the ramp construction will now be set forth in detail.

Referring to FIGS. 2*b*, 2*c* and 7, it will be seen that the ramp consists structurally of paired I-beams 101, 102. I-beams 101 and 102 are in spaced apart relation. A typical detail of the I-beams is shown in FIG. 4*d*.

Figure 4C:
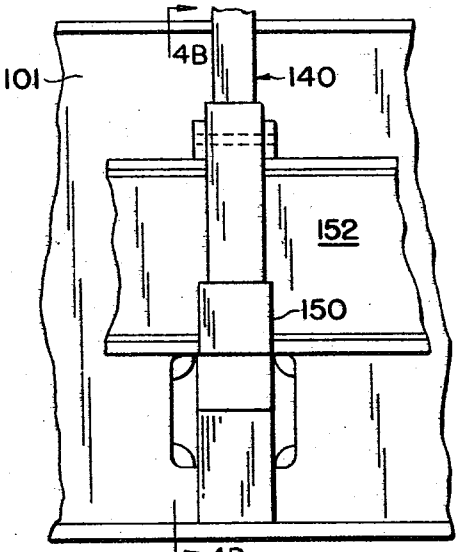

Referring to FIG. 4d, I-beam 101 is illustrated. As I-beam 102 is a mirror image of I-beam 101, it will not be set forth here in detail.

I-beam 101 includes a central web 103 and spaced apart flanges 105, 106. The drill rig between the beams 101, 102 is cross-braced by box beams 107. These box beams hold the I-beams in rigid spaced apart relation.

It is necessary that the I-beams define a railway. This railway is used by car C traveling up and down the I-beams.

We have found that the construction of this railway has to be of surprising strength. Specifically, an angle 108 is welded below flange 105. On top of this angle, there is placed a wear plate typically of the type of steel used for cam rollers. Wear plate 109 is the surface upon which car C normally rides.

Because of I-beam warpage in the placing of welds and more importantly because of the extreme torque and carloading forces on the I-beams, supporting angle 108 must be intimately reinforced. Specifically, it includes an opposite piece of flat stock 110 welded to the beam. Stock 110 is in turn reinforced by an upper gusset 112 and a lower gusset 114. The angle itself is reinforced by a gusset 115. Thus flange 105 and the angle 108 are effectively reinforced on three separate sides.

Additionally, each box beam 107 holding the I-beams 106 in spaced apart relation is braced by gussets. These gussets shown at 117 and 118 extend angularly upward from the box beam to the underside of the angle.

It will be remembered that car C weighs approximately 16 tons. Moreover, this car is loaded by considerable torque forces. Because of these loadings, the intimate reinforcing of the track along the inside edge of both I-beams 101 and 102 is required. Therefore the reinforcing detail of FIG. 4*d* extends from one end of the drill rig to the opposite end of the drill rig.

It should be understood that when the two discrete sections B and D of the ramp are separate and apart from each other, the opened ends of the medial section of the I-beams 101 and 102 appear not unlike the detail at FIG. 4*d*. It is into such an opening that the traveling car C can be threaded during erection of the drill rig.

Referring to the front perspective view of the drill rig shown in FIG. 7, it will be seen that the invention shown herein includes a catwalk 130, and a rail 140. The catwalk and rail have been found necessary to permit crews servicing the drill rig with lengths of pipe and the like to be able to freely walk anywhere on the rig independent of the path of car C. However, since the catwalk has an unacceptable highway width to the rig, provision is made for its telescoping support. This can best be understood with reference to the details in FIGS. 4*a*–*4c*.

Figure 4B:
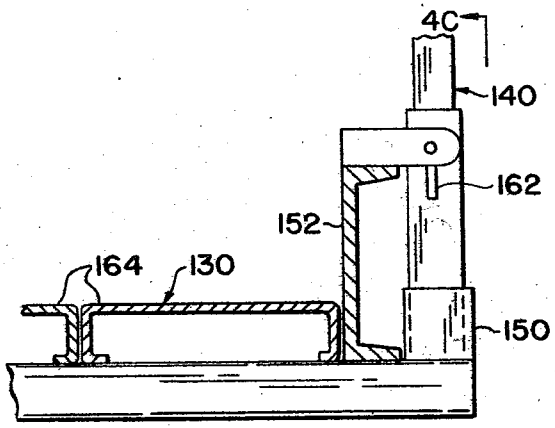
Figure 4A:
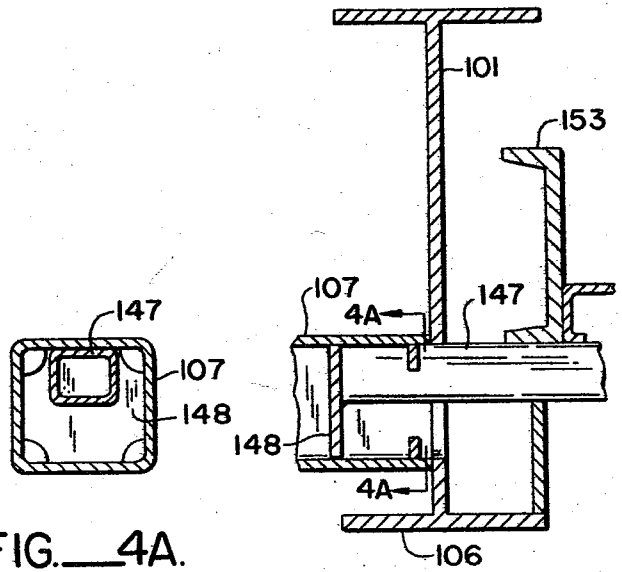

Referring to FIG. 4*a*, box beam 107 is shown. Beam 107 contains therewithin a smaller box beam 147. This beam 147 is welded to an end plate 148 which slides within box beam 107 (see detail of FIG. 4*b*).

Referring to FIG. 4*b*, it can be seen that the web of I-beam 101 is apertured immediately above lower flange 106 (note that the upper rail section is not shown for ease of description). Box beam 147 telescopes into and out of box beam 107. End plate 148 serves to maintain the axial alignment of box beam 147. This axial alignment of beam 147 is parallel to the axis of beam 107.

At the outward end, box beam 147 has an upwardly facing stanchion support 150. Inboard of stanchion support 150 there is welded a U-sectioned angle 152. Similarly, and adjacent I-beam 101 there is welded a U-section angle 153.

Operation of the catwalk system can be easily understood. Specifically, when the drill rig arrives on site, box beam 147 is telescoped within box beam 107. U-shaped angles 153, 152 confront one another at the bottom outside their U-sectioned surfaces. In assembly, box beams 147 are telescoped outwardly their full length. As being telescoped outwardly, they form the supporting surface to the catwalk.

Typically, rail stanchions 140 are set pinned in place at elongate apertures 162. These sections are then set downwardly and into the stanchion braces 150. The combination of a pin through aperture 162 and the stanchion brace 150 serves to hold the rails 140 in the upright position.

At the same time, ramp sections 164 placed intermediately of angle sections 152 and 153 form the surface of the catwalk. This surface 130 forms the walkway surface on the inclined drill rig. Because it is an inclined walkway which includes a surface ambient to the mud and dirt associated with drilling, it is typically made of a corrugaged material, perforated in numerous places, which provides a high friction surface for operating workmen.

Referring to FIG. 7, it will be seen that the box beams 107 have strung therebetween catwalk material 170. This catwalk material is immediately in front of the traveling path of the car C. In this location, it is found necessary to use the catwalk material 170 as a work surface. Workmen frequently inspect pipe, engage pipe, disengage pipe, and lower pipe into position on the surface. This being the case, it is most important that this surface be a firm and level surface from which work can easily occur. Since the ramp is inclined, it has been found both convenient and necessary to incline this surface. The manner in which this surface is inclined can be seen with respect to the detail of FIG. 4*e*.

Figure 4E:
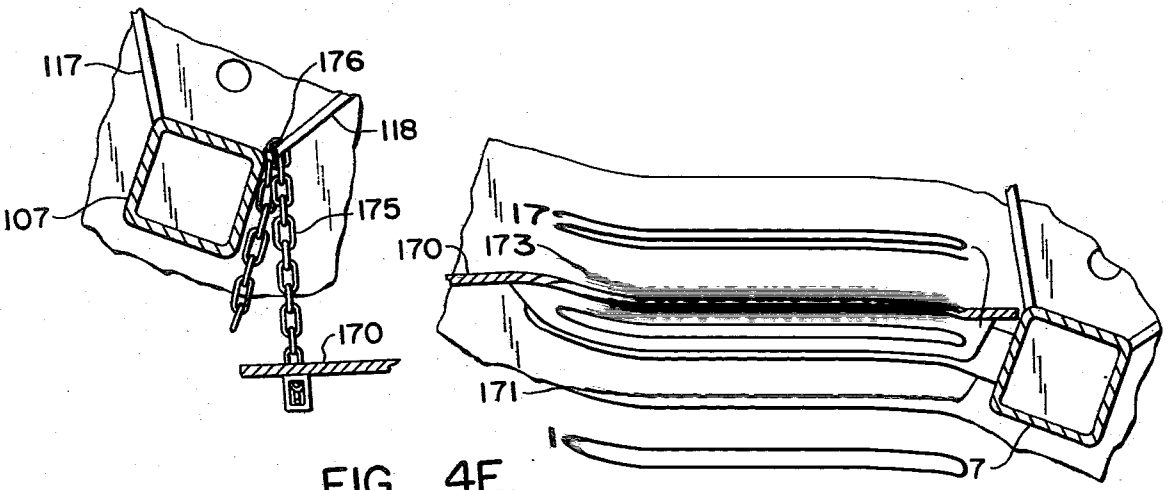

As shown in FIG. 4*e*, the rear surface of the box beam 107 has ears 171 protruding therefrom. These ears 171 are cross-bored with a corresponding ear 172 at a hinge aperture 173. The walkway section 170 at the forward end is pivoted about the pin 173.

At the rearward end, each section 170 is provided with a chain 175. Chain 175 typically extends over and engages a hook 176 on the box beam 107 in the vicinity of the box beam gussets 118. It can thus be seen that the surfaces 107 and their box beams to which they are attached provide a convenient series of long level steps extending up the entire length of the ramp. These long level steps provide ideal work surfaces.

Having generally set forth the construction of the ramp, attention can now be directed to traveling car C. Traveling car C is shown in FIG. 5 and includes paired longitudinal beams 201 and 202. These longitudinal beams are cross-connected at three cross members 203, 204 and 205. Together the longitudinal members and cross members make up a rigid supporting frame for the traveling car C. The car fits on and travels within the paired rail sections previously illustrated with respect to FIG. 4*d*.

The car rides on eight cam rollers 206. Pairs of cam rollers 206 each are placed on four pivoted walking beams 207. Pivoted walking beams are placed in four supporting locations on the frame of traveling car C.

The cam rollers 206 are provided with a narrow quarter inch clearance between the bottom of flange 105 and the upper surface of wear strip 109. These rollers serve the purpose of distributing the weight of the car along the wear strip. Additionally, the rollers can bear against either the wear strip or the bottom of flange 105. Thus, when car C has large overturning torques applied to it, wheels 206 can bear in either direction.

It should be noted that the paired rear rocker arm assemblies 207 and wheels 206 are mounted a distance forward from the rearward end of car C. This mounting imparts to the car a shorter overall length. With the shorter overall length, torque forces applied to the car will have a smaller warping effect on the frame. Additionally, by mounting the wheels 206 forwardly, the rear section of the car can overhang the end of the rig. The car is thus given a greater range of rear movement along the rig.

Overlying each of the rocker arms 207 there are lifting ears 209. Ears 209 are the means by which the car can be independently lifted and threaded into a forward ramp section B when the rig is in the partially assembled configuration previously illustrated in FIG. 2*a*.

Once the car is placed within the rig in the partially assembled disposition of FIG. 2*a*, a detachable cab 210 is mounted onto the rig. Detachable cab 210 provides a sheltered operating station for both the operator and the controls of this rig, these controls being illustrated with respect to FIG. 8.

Figure 5A:
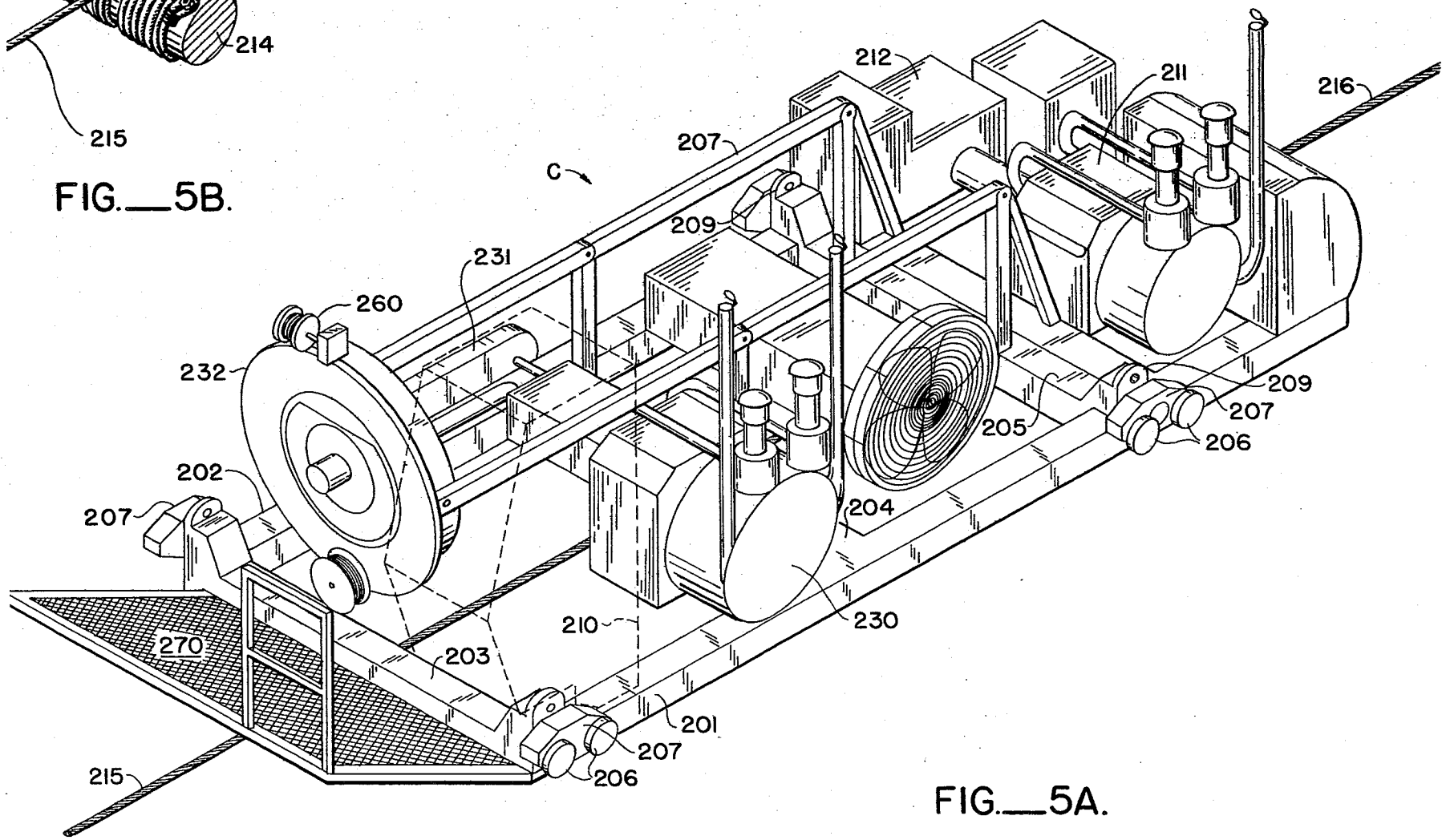
Figure 5B:
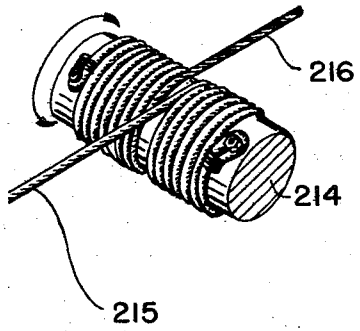

Having set forth the chassis, the components mounted to the traveling car may now be discussed. Referring to FIGS. 5*a* and 5*b*, a diesel engine 211 is mounted to car C and powers through its output a hydraulic transmission 212. Transmission 212 drives a hydraulic hoist 214 (see detail of FIG. 5*b*). The driven hoist is typically of the hydraulic variety and may be purchased from the Gearmatic Corporation of Montreal, Canada. The hydraulic transmission is of the Waterberry Speed Gear variety and can be purchased from the Sunstrand Corporation of Ames, Iowa under Model 28-4101. Variable hydraulic output in either of two directions is provided by control of a tilting plate.

Hoist 214 has two cables wound thereabout. A first cable 215 extends to the bottom of the ramp; a second cable 216 extends to the top of the ramp. Each of the cables 215, 216 is as long as the combined ramps B and D and are deadended at the hoist. Thus, rotation of the hoist in either direction permits movement of the car in either selected direction.

The hydraulic input to the hoist is carefully measured and displayed at a control panel interior of the cab. (See gauges 220, 222 in FIG. 8.) These gauges monitor the crowding pressure applied to car C for moving the car. By monitoring the crowding pressure, the strength of material limits of the drill pipe will not be exceeded. Moreover, as is pointed out in U.S. Pat. No. 3,878,903, issued Apr. 22, 1975, entitled "Apparatus and Method For Drilling Underground Arcuate Paths," the crowding pressure applied to a drill in placing inverted underground arcuate paths is critical. This pressure can be monitored and carefully controlled by observations of the pressure at either of gauges 220, 222.

The chassis of car C includes a second engine 230 mounted thereto. This engine drives through a standard transmission a drilling rotary table 232. For example, a Cal-Weld Model 130 Rotary Table is illustrated here driven by a sprocket and chain contained in a chain case 231. As is standard in the art, auxiliary lubrication supplies and the like are provided to the drill table. The Cal-Weld Rotary Table can be obtained from the Cal-Weld Company of Santa Fe Spring, Calif The drill table is operable to rotate in either direction. As has been pointed out in the above-referenced U.S. Pat. No. 3,878,903, this drill table applies a fixed angular alignment to any drill string being introduced into the ground. This can be attained by maintaining the drill table at a constant angular alignment.

At the same time, when a casing is being introduced about a previously installed pilot string, the drill table 232 can be rotated. This rotation can periodically occur simultaneously with a crowding force applied by car C. The resultant force applies a simultaneous rotation and crowding into the ground of concentrically installed production casing.

Figure 9:
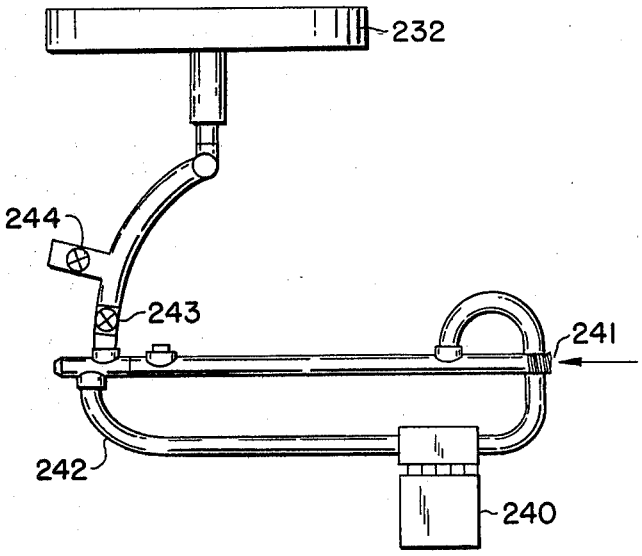
FIG. 9 is a hydraulic schematic.

Engine 230, through a hydraulic output, also drives a positive displacement fluid pump 240 (see FIG. 9). Pump 240 takes fluid at 241 from an intake and channels it through the pump 240 to a pressure output 242. Fluid, such as driller's mud, passes through a remotely operating valve 243 and then to the table 232. At the table 232, the fluid may be supplied under variable pressure to the rotating drill head.

Again, as set forth in U.S. Pat. No. 3,878,903, the amount of pressure applied to the pipe and any motor driven drill at the end of the pipe being installed in the ground can be critical. Such pressure therefore is conveniently displayed on the control panel at a gauge 248.

When drilling under pressure has occurred, it is necessary to relieve the fluid pressure interior of the drill string. Such relief may be obtained by closing valve 243 and opening a vent valve 244. With the release of hydraulic drilling fluid pressure within the line, the piping may be safely uncoupled either from the drill table or from segments of pipe partially installed within the ground.

It is useful to determine the position of the pilot string by means of a survey tool attached to a wire line. Consequently a wire line winch 260 is used to withdraw the survey tool from the interior of the ground. This wire line winch 260 is typically mounted immediately overlying the turntable 232.

Figure 8:
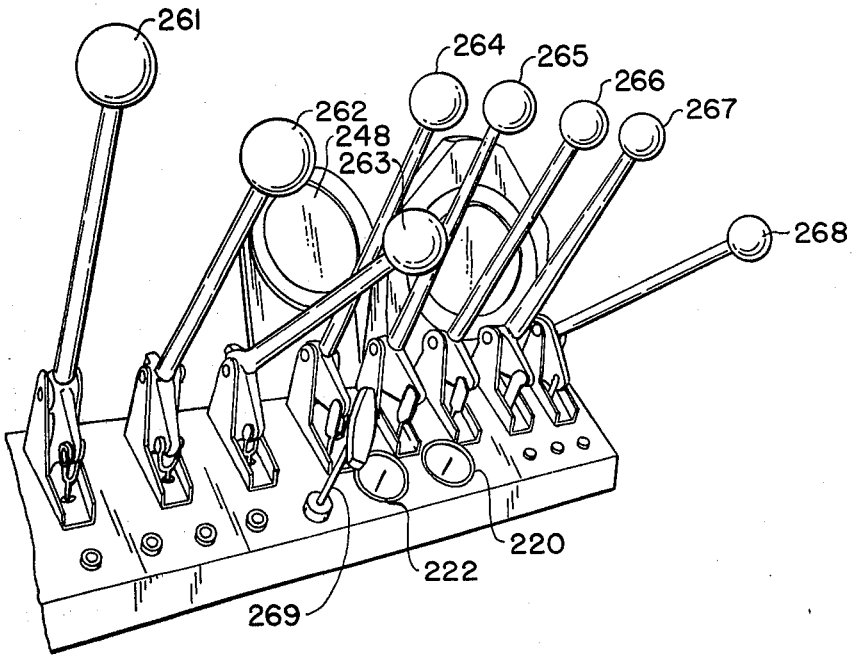
FIG. 8 is a portion of the control panel of the cab of the drill rig.

Referring to FIG. 8, a typical control panel is shown. The linkages between the actuating levers and the various operating components of the apparatus are all conventional control cables; they are not specifically illustrated.

Referring to FIG. 8, knob 261 shifts winch 261 into gear. Knob 262 controls the speed of winch 261 in retrieving survey tools from the ground. Knob 263 controls the speed and pressure of the hydraulic fluid pump 240. Knob 264 controls both the speed and direction of the Gearmatic hydraulic winch by controlling the tilting plate of the variable output Waterberry speed gear. (For example, a Sunstran Hydrotransmission made by the Sunstran Corporation of Ames, Iowa.) By movement of this lever 264 either forwardly or rearwardly, correspondent forward and rearward movement of cab C may be obtained. Lever 265 is a throttle for engine 230. Lever 266 controls the direction of the rotary table movement of table 232. Lever 267 controls the gear ratio of the rotary table. Finally, lever 268 controls the opening and closure of valve 243. Opening and closure of this valve permits mud under pressure from pump 240 to be communicated to the rotary table.

Operation of the remotely controlled valve 244 occurs from a lever 269. This relieves pressure accumulated interior of the drill string when all pumping ceases.

Traveling car C includes on the forward end thereof a ramp 270 which is a traveling work station moving along with the car at which connection of piping and the like can be made to the rotary turntable 232. It is also a convenient station for operating personnel to stand while the car advances piping into and out of the ground.

I claim:

1. An inclined drill rig for drilling piping along an angularly inclined ramp into the ground comprising in combination: a forward ramp section including a forward support point for resting a portion of said ramp on the ground; an after ramp section; each ramp section including legs for supporting a portion of said ramp section on the ground; means for coupling said ramp sections together attached to each of said ramp sections at one end thereof, said coupling means including means for pivoting said ramp sections from an angular disposition between said ramp sections to a linear disposition between said sections, said coupling means further including means for locking said ramp sections in a linear erected relation; and, leg support means attached to each of said ramp sections whereby one of said ramp sections is supported at paired support points on the ground and the other of said ramp sections is supported by its legs and said coupling means.

2. The invention of claim 1 and including a car mounted to said ramp section for travel on railways between said forward and after ramp sections; said car including a rotating table and a fluid pump assembly for supplying fluid to said rotating table.

3. The invention of claim 1 and wherein each of said ramp sections includes paired spaced apart I-beams extending longitudinally of said ramp section and rails are mounted within and between the flanges of said I-beams.

4. The invention of claim 1 and wherein each said ramp sections include removably attached wheels for separate rolling transport of each of said ramp sections.

5. The invention of claim 4 and wherein each of said ramp sections includes a fifth wheel remote from said removably attached wheels for discrete towing of said ramp sections by tractors.

6. A portable drill rig for drilling piping along an arcuately inclined ramp comprising in combination: a ramp section; said ramp section including legs for support of said ramp, said legs movable between a first confronted position to said ramp for transport of said rig, and a second over-center position with respect to the ground for bracing said rig in the supported position; said ramp section including railways which permit travel of a car along said angularly inclined ramp; running rigging means mounted to said ramp; and, flexible tension means attached to said car and legs mounted over said running rigging means to permit movement of said car on said ramp to be imparted to said legs to move said legs to and from said supported position.

7. The invention of claim 6 and wherein said ramp includes first and second ramp sections with said first and second ramp sections each having legs and corresponding running rigging means.

8. A process of erecting a rig including providing a long inclined ramp; providing attached to said ramp legs pendulously movable from a position of confrontation to said ramp to an over-center position with respect to said ramp; providing a car mounted to said ramp operable to move forwardly and rearwardly on said ramp; providing flexible tension means attached to said car at one end and to said legs at the opposite end, placing running rigging on said ramp, and moving said car on said ramp to move said legs to and from a supporting position with respect to said ramp.

9. The invention of claim 8 and wherein said ramp includes first and second ramp sections; said second ramp section including hingeably movable legs movable between a confronted position to said ramp and an over-center supporting position to said ramp; and providing a running rigging means on said second ramp to permit said flexible tension means to pull legs on said after ramp to said supported position.

10. An angularly inclined drill rig for drilling piping along an angularly inclined ramp into the ground comprising in combination: a forward ramp section including a forward support point for resting a portion of said ramp on the ground; an after ramp section including legs for supporting a portion of said ramp section on the ground; means for coupling said ramp sections together attached to each of said ramp sections at one end thereof, said coupling means including means for pivoting said ramp sections from an angular disposition between said ramp sections to a linear disposition between said sections, said coupling means further including means for locking said ramp sections in a linear erected relation; leg support means attached to each of said ramp sections whereby one of said ramp sections is supported at paired support points on the ground and the other of said ramp sections is supported by its respective legs and said coupling means; a car movable along said ramp section; means attached to said car for causing powered movement of said car along said ramp; a rotary table mounted to said car; and, said rotary table operable to simultaneously rotate and crowd piping into the ground.

11. The invention of claim 10 and wherein said ramp sections provide along at least one side thereof beams for supporting a catwalk; said catwalk supporting means including means telescoping into and out of said forward ramp section and into and out of said after ramp section.

12. The invention of claim 10 and wherein said car includes means for pumping fluid to piping mounted to said rotary table.

13. The invention of claim 10 and wherein said car includes at the forward portion thereof a platform; said platform disposed in front of said drilling table for supporting personnel working on said drilling table during movement of said car.

* * * * *